US006016660A

United States Patent [19]

Abramshe

[11] Patent Number: 6,016,660

[45] Date of Patent: Jan. 25, 2000

[54] CRYO-SEDIMENTATION PROCESS

[75] Inventor: Ron Abramshe, Oxford, Mass.

[73] Assignee: Saint-Gobain Industrial Ceramics, Inc., Worcester, Mass.

[21] Appl. No.: 09/079,053

[22] Filed: May 14, 1998

[51] Int. Cl.[7] ..... F25D 17/02

[52] U.S. Cl. ..... 62/64; 62/74; 209/18

[58] Field of Search ..... 62/64, 74; 209/18

[56] References Cited

U.S. PATENT DOCUMENTS 2,875,588 3/1959 Berger ..... 62/74

4,282,745 8/1981 Burr ..... 73/61.68

4,483,768 11/1984 Gazzoni ..... 209/18

5,516,968 5/1996 Abel ..... 588/1

*Primary Examiner*—Ronald Capossela

*Attorney, Agent, or Firm*—David Bennett

[57] ABSTRACT

Cryogenic sedimentation is effective to bring about the rapid separation of sub-micron particles from powder mixtures containing such particles without leading to significant agglomeration.

5 Claims, No Drawings

CRYO-SEDIMENTATION PROCESS

BACKGROUND OF THE INVENTION

The present invention relates to the separation of finely divided powders into fractions with a specific size range and particularly to the separation of powders in the sub-micron size range.

Historically the separation by size of such very fine powders has been done using a sedimentation technique that relies on the differential rate of sedimentation of particles as predicted by Stokes' law. In practice the larger the particle, the faster it is deposited therefore if chemically identical powders with a range of sizes are dispersed in a dispersion medium in which the particles are not soluble, such as water, the heavier particles settle out first, followed by the next heavier and so on until the finest are deposited. The separation is usually carried out in a column and the sediment at the bottom of the column after all particles have settled out will have the finer particles collected in the top layers and the heavier particles in the bottom layers. This is sometimes accomplished in a cascade of separator columns each separating out a fraction of the particle sizes to minimize the waiting time. This can be quite considerable since sub-micron particles dispersed in water can take weeks to settle out. Working with a cascade of columns allows the larger sizes to be removed relatively quickly so as to leave the finer particle sizes behind.

In an attempt to speed up the process of settling out the finest particles, a settling agent of a lower density such as alcohol may be added to the dispersion medium and this is successful to some degree but the time taken to separate sub-micron particles is still very long. In addition the mixture then has to undergo dialysis to remove the settling agent before the powder is dried.

A further problem arises when drying the sub-micron particles. If the separation from the dispersion medium involves heating this causes the particles to agglomerate. There has been some success in drying the powders using a freeze drying technique. This reduces the agglomeration but does nothing to shorten the separation process.

Another separation technique involves elutriation in which a dispersion of the particles in, for example, water is cause to flow at a defined rate. This passes through a series of vessels of increasing diameter. The finer particles will travel further than the coarser such that a separation can take place. Once again however the problems of separation from the dispersion medium and drying discussed above are encountered.

A process for separating very fine particles has now been developed that can be completed in a fraction of the time taken using prior art techniques. Moreover the process allows rapid controlled drying without agglomeration. In this way the process of the invention represents an inexpensive, convenient and effective means for producing fine, and particularly sub-micron, powders from powder mixtures.

DESCRIPTION OF THE INVENTION

The present invention provides a sedimentation process for the separation by particle size of fine powders in which the sedimentation medium is a liquid that is a gas above 0° C. For this reason the process is referred to herein as "cryogenic sedimentation".

It is found that cryogenic sedimentation occurs much more rapidly than separation using conventional separation media. In addition the removal of the medium after sedimentation has proceeded to the desired degree is very easily accomplished by simply raising the temperature above zero.

The preferred medium depends on the powder to be separated but in general a liquified gas that is relatively inert and environmentally neutral is preferred. Liquifiable atmospheric gases are suitable including liquid nitrogen or oxygen and liquified rare gases such as argon, or neon could be substituted albeit at a higher cost. In addition other liquifiable gases such a lower hydrocarbons such as methane and mixtures of such gases and liquifiable halohydrocarbons and ammonia. Clearly however many of the potential options could only be safely or responsibly used in closed systems where the gases could not escape into the environment. In general therefore, for most applications, the preferred cryogenic separation medium is liquid nitrogen.

The powders to be separated are not limited except by their stability under cryogenic conditions. The most usual powders to which the process might be applied are ceramic oxides such as alumina, magnesia, titania, zirconia and silica though this by no means a necessary limitation on the sort of powders to which the invention may be applied.

In the operation of a preferred process of the invention a pressurized, insulated column is prepared and filled with liquid nitrogen. When equilibrium has been reached a powder having particles of a plurality of sizes is introduced at the top of the column and stirred to disperse the powder thoroughly in the medium. The particles are then allowed to sediment until the larger and undesired particles have sedimented out. Thereafter the liquid nitrogen remaining, which still has the finer particles dispersed therein, is separated and the nitrogen is removed from the pressurized enclosure so as to permit evaporation of the liquid nitrogen at a controlled rate. Generally this process should not be too rapid as some of the powder could be entrained in the evaporating liquid and be carried away. When all the nitrogen has been removed, the fine particles size fraction of the starting powder remains in an essentially unagglomerated and freely flowing form.

The particle sizes to which the cryogenic separation process of the invention can be applied are not constrained by any of the necessary features of the process. Thus the range of particle sizes can be for example from 0.01 micrometer to 100 micrometer or more. However since larger particles generally sediment at a reasonably rapid rate in dispersion media such as water, the advantages of cryogenic separation in terms of speed of sedimentation are not so significant. Thus the cryogenic sedimentation process is most conveniently applied to separate powder particle sizes below about 5 micrometers and particularly below about 1 micrometer such as for example from 0.1 to 1.0 micrometer.

DESCRIPTION OF THE PREFERRED EMBODIMENTS

The invention is now described with reference ton the following example which is provide solely for the purpose of illustrating the invention and should not be understood to imply any necessary limitation of the scope of the invention.

EXAMPLE

A vertically oriented, cylindrical stainless steel pressure vessel was fitted with a superinsulating jacket and means to sense temperature and pressure. The bottom two thirds of the vessel was provide with an exterior coil wrap capable of circulating liquid at −20° C. to +40° C. The vessel was filled with liquid nitrogen while the circulating liquid in the coil was at −20° C. The material to be separated by particle sizes was a synthetic diamond powder for which a particle size distribution curve had previously been generated. The diamond powder was mixed with a carrier of liquid nitrogen in an amount to give a 20–25% solids slurry and then introduced into the cylinder of liquid nitrogen which had been pressurized to about 200 atmospheres. The diamond particles were then allowed to settle to the bottom, with the largest particles falling fastest and the smallest slowest such that, at the bottom the particles are size segregated with the largest at the bottom and the smallest at the top. When the sedimentation is completed the temperature in the coil is allowed to rise and the vessel is opened to the atmosphere such that the nitrogen is evacuated leaving a cake of diamond powder. Because the powder has seen no heating, there is no agglomeration and the cake can be sliced tp remove volume proportions corresponding to the various size ranges previously identified in the powder.

In this way a very accurate separation can be made of all the size ranges present in the mixture and the fractions are immediately usable because they are non-agglomerated.

The separation process of the invention can be applied to any powder containing a variety of particle sizes providing a cryogenic solvent can be found that does not interact with the powder at the temperatures at which the cryogenic separation process is conducted.

What is claimed is:

1. A process for the separation by particle size of fine, chemically homogeneous, mineral powders by differential sedimentation rates in which the sedimentation medium is a liquid that is a gas above 0° C.

2. A process according to claim 1 in which the powders comprise a particle size fraction with sizes from 0.1 micrometer to 1 micrometer.

3. A process according to claim 1 in which the sedimentation medium is selected from the group consisting of liquified atmospheric gases.

4. A process according to claim 1 in which the sedimentation medium is liquid nitrogen.

5. A process according to claim 1 in which the fine powder is selected from the group consisting of ceramic oxides and diamond.

* * * * *